US011453051B2

(12) United States Patent
Jablonski et al.

(10) Patent No.: US 11,453,051 B2
(45) Date of Patent: Sep. 27, 2022

(54) CREEP RESISTANT NI-BASED SUPERALLOY CASTING AND METHOD OF MANUFACTURE FOR ADVANCED HIGH-TEMPERATURE APPLICATIONS

(71) Applicant: United States Department of Energy, Washington, DC (US)

(72) Inventors: Paul D. Jablonski, Salem, OR (US); Jeffrey Hawk, Corvallis, OR (US); Martin Detrois, Salem, OR (US)

(73) Assignee: United States Department of Energy, Washington, DC (US)

( * ) Notice: Subject to any disclaimer, the term of this patent is extended or adjusted under 35 U.S.C. 154(b) by 0 days.

(21) Appl. No.: 17/184,542

(22) Filed: Feb. 24, 2021

(65) Prior Publication Data

US 2022/0266332 A1 Aug. 25, 2022

(51) Int. Cl.

| | |
|---|---|
| ***B22D 25/06*** | (2006.01) |
| ***B22D 21/02*** | (2006.01) |
| ***B22D 18/06*** | (2006.01) |
| ***C22F 1/10*** | (2006.01) |
| ***F27B 14/06*** | (2006.01) |
| ***F27B 14/10*** | (2006.01) |
| ***C22C 19/05*** | (2006.01) |

(52) U.S. Cl.

CPC ..... *B22D 25/06* (2013.01); *B22D 18/06* (2013.01); *B22D 21/025* (2013.01); *C22C 19/05* (2013.01); *C22F 1/10* (2013.01); *F27B 14/061* (2013.01); *F27B 14/10* (2013.01); *C22C 2202/00* (2013.01); *F27B 2014/066* (2013.01)

(58) Field of Classification Search

CPC ..... B22D 18/06; B22D 21/02; B22D 25/06; C22C 19/05; C22F 1/10

USPC ..... 164/47, 61, 48, 492, 493, 495

See application file for complete search history.

(56) References Cited

U.S. PATENT DOCUMENTS

| | | | | |
|---|---|---|---|---|
| 5,443,111 A * | 8/1995 | Colvin et al. | ..... | B22C 9/061 164/254 |
| 6,561,258 B1 * | 5/2003 | Kumpula | ..... | C21D 8/005 148/335 |
| 2012/0110813 A1 * | 5/2012 | Bullied et al. | ..... | B22D 17/20 29/423 |
| 2014/0083645 A1 * | 3/2014 | Waniuk et al. | ..... | B22D 35/04 164/493 |

* cited by examiner

*Primary Examiner* — Kevin P Kerns

(74) *Attorney, Agent, or Firm* — Aaron R. Keith; Timothy L. Harney; Michael J. Dobbs

(57) ABSTRACT

One or more embodiments relates to a method of casting a creep-resistant Ni-based superalloy and a homogenization heat treatment for the alloy. The method includes forming a feed stock having Nickel (Ni) and at least one of Chromium (Cr), Cobalt (Co), Aluminum (Al), Titanium (Ti), Niobium (Nb), Iron (Fe), Carbon (C), Manganese (Mn), Molybdenum (Mo), Silicon (Si), Copper (Cu), Phosphorus (P), Sulfur (S) and Boron (B). The method further includes fabricating the creep-resistant Ni-based superalloy in a predetermined shape using the feed stock and at least one process such as vacuum induction melting (VIM), electroslag remelting (ESR) and/or vacuum arc remelting (VAR).

19 Claims, 18 Drawing Sheets

CREEP RESISTANT NI-BASED SUPERALLOY CASTING AND METHOD OF MANUFACTURE FOR ADVANCED HIGH-TEMPERATURE APPLICATIONS

STATEMENT OF GOVERNMENT SUPPORT

The United States Government has rights in this invention pursuant to the employer-employee relationship of the Government to the inventors as U.S. Department of Energy employees and site-support contractors at the National Energy Technology Laboratory.

FIELD OF THE INVENTION

Embodiments relate to a Ni-based superalloy casting and method of manufacture such a superalloy casting for advanced high temperature applications. More specifically embodiments relate to creep resistant NiCrCoAlTi (Ni-based) superalloy casting and method of manufacture the same for advanced super critical carbon dioxide ($sCO_2$) power cycles.

BACKGROUND

Coal-fired boilers and steam/$CO_2$ turbines have operating temperatures greater than 760° C. over the long-term. Additionally, such boilers and turbines have high-temperature creep strength requirements in pressurized steam cycles. Superalloys in both wrought and cast forms are needed to replace ferritic-martensitic high strength steels and austenitic stainless steels to meet the long-term, high-temperature creep strength requirements in these pressurized steam cycles.

Superalloys, such as Ni-based superalloys, in both wrought and cast forms, are used to replace ferritic-martensitic high strength steels and austenitic stainless steels to meet the long-term, high-temperature creep strength requirements in these pressurized steam cycles.

IN740H is a boiler certified alloy, meeting component requirements for steam transfer and boiler pipes. IN740H has been used to manufacture boiler tubing, header and re-heater pipe as well as small fittings. The production of IN740H involves combinations of processes before fabrication into shape, such as vacuum induction melting (VIM), electroslag remelting (ESR) and/or vacuum arc remelting (VAR). While IN740H satisfies the performance requirements of A-USC designs in its wrought version, using the alloy in its cast form would be valuable in terms of range of component sizes, geometries and complexities, as well as cost.

Prior efforts made at producing articles of as-cast IN740H resulted in poor creep performance when compared to wrought IN740H articles. Several compositions within the nominal specified range for IN740H were investigated but failed to provide a material in the as-cast form that would withstand long-term, high-temperature exposure in creep.

In the future, advanced A-USC and/or $sCO_2$ power plant designs are expected to raise the efficiencies of coal-fired power plants from ~35 to >50%. It should be appreciated that improving the performance of the NiCrCoAlTi cast article over that of the existing conventionally cast versions of IN740 may provide as-cast material solutions that may withstand the higher operating temperatures found in advanced fossil energy power plants. A need exists in the art to develop a superalloy, such as a NiCrCoAlTi superalloy casting based on the nominal chemistry of INCONEL 740/740H (IN740H). With operating temperatures of components in the coal-fired boiler and steam/$CO_2$ turbine greater than 760° C., Ni-based superalloys in both wrought and cast forms are needed to replace ferritic-martensitic high strength steels and austenitic stainless steels to meet the long-term, high-temperature creep strength requirements in these pressurized steam cycles.

SUMMARY

One object of at least one embodiment is related to a method of casting a creep-resistant Ni-based superalloy. The method includes forming a feed stock comprising Nickel (Ni) and at least one of Chromium (Cr), Cobalt (Co), Aluminum (Al), Titanium (Ti), Niobium (Nb), Iron (Fe), Carbon (C), Manganese (Mn), Molybdenum (Mo), Silicon (Si), Copper (Cu), Phosphorus (P), Sulfur (S) and Boron (B). The method further includes fabricating the creep-resistant Ni-based superalloy in a predetermined shape using the feed stock and at least one process comprising vacuum induction melting (VIM), electroslag remelting (ESR) and/or vacuum arc remelting (VAR).

One or more embodiments include the feed stock comprises at least Nickel (Ni) and Chromium (Cr).

One or more embodiments include melting the feed stock in a furnace, forming a liquid metal; pouring the liquid metal into a preheated mold, forming a molten metal; and solidifying the molten metal in the preheated mold, forming the creep-resistant Ni-based superalloy in the predetermined shape.

In one or more embodiments the feed stock is placed into a crucible inside the furnace, where the crucible may be a zirconia crucible inside the furnace and/or the furnace comprises a VIM furnace.

In one or more embodiments, the method includes melting the feed stock is carried out under vacuum and/or at a partial pressure between 50 and 400 Torr of Argon (Ar). Additionally, melting the metal Ni-based superalloy includes pouring the liquid metal into the mold when the temperature of the liquid metal is between 1 and 10 degrees Celsius above the melting temperature of the loaded feed stock.

In still other embodiments, the preheated mold is a graphite mold that is preheated to 500±200° C. (about 300° C. to about 700° C.) for a time ranging from about 10 minutes to about 5 hours. Additionally, the mold includes a zirconia wash coat.

Still another embodiment includes homogenizing the cast alloy including performing at least two of the sequential steps of treating the cast alloy between about 0.5 to about 5 hours at about 1050° C. to about 2000° C. (more specifically about 1075° C.); 1.5 to 3 hours at 1125±25° C.; 3 to 15 hours at 1200±25° C.; 3 to 24 hours at 1250±25° C.

In still other embodiments, the homogenized alloy is subjected to an aging heat treatment consisting of heating between about 4 to about 20 hours at about 800° C.;

Still another embodiment includes a method of casting a creep-resistant Ni-based superalloy, the method including loading the feed stock comprising Nickel (Ni) and at least one of Chromium (Cr), Cobalt (Co), Aluminum (Al), Titanium (Ti), Niobium (Nb), Iron (Fe), Carbon (C), Manganese (Mn), Molybdenum (Mo), Silicon (Si), Copper (Cu), Phosphorus (P), Sulfur (S) and Boron (B) into a crucible inside a VIM furnace. The method further includes melting the feed stock forming a liquid metal; pouring the liquid metal into a preheated mold in the VIM furnace, forming a molten metal; and solidifying the molten metal in the preheated mold, forming the creep-resistant Ni-based superalloy in a predetermined shape.

Other embodiments relate to a method of casting a creep-resistant Ni-based superalloy. The method includes loading the feed stock into a crucible inside a VIM furnace, melting the feed stock forming a liquid metal, pouring the liquid metal into a preheated mold in the VIM furnace, forming a molten metal; and solidifying the molten metal forming an as-cast article of the creep-resistant Ni-based superalloy in a predetermined shape. The method includes the feed stock includes Nickel (Ni) and at least one of Chromium (Cr), Cobalt (Co), Aluminum (Al), Titanium (Ti), Niobium (Nb), Iron (Fe), Carbon (C), Manganese (Mn), Molybdenum (Mo), Silicon (Si), Copper (Cu), Phosphorus (P), Sulfur (S) and Boron (B). Melting the feed stock is performed in at least one of a vacuum and at a partial pressure between 50 and 400 Torr of Argon (Ar)

BRIEF DESCRIPTION OF THE DRAWINGS

The invention together with the above and other objects and advantages will be best understood from the following detailed description of the preferred embodiment of the invention shown in the accompanying drawings, wherein.

DETAILED DESCRIPTION

The foregoing summary, as well as the following detailed description of certain embodiments of the present invention, will be better understood when read in conjunction with the appended drawings.

The following detailed description should be read with reference to the drawings in which similar elements in different drawings are numbered the same. The drawings, which are not necessarily to scale, depict illustrative embodiments and are not intended to limit the scope of the invention.

Figure 1:
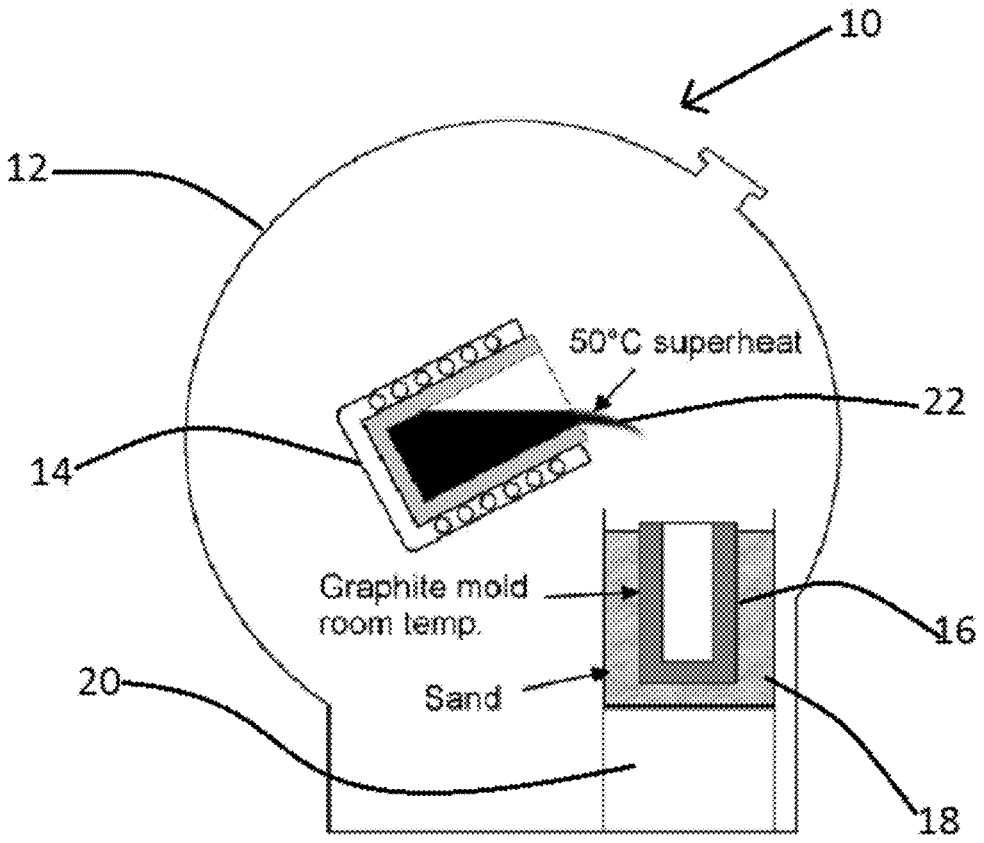
Prior Art FIGURE 1
FIG. 1 depicts a representation of a conventional/prior art casting system.

FIG. 1 depicts a representation of a known conventional casting system, generally designated 10. The system 10 includes a furnace 12, a VIM furnace for example, having a crucible 14. As depicted, furnace 12 further includes a mold 16, a graphite mold at room temperature, submerged in sand 18 on stand 20. The known casting system 10 illustrates superheat liquid 22, a 50° C. superheat liquid, that in poured into mold 16. The sand 18 cools the liquid in the mold 16 forming ingots.

One or more embodiments relates to a casting approach named Fine Grain Homogenized (FGH) to enable the use of a Ni-based superalloy, a NiCrCoAlTi superalloy for example, nominally based on IN740H, for cast articles in A-USC and $sCO_2$ power plants. The composition of the NiCrCoAlTi superalloy is within the limits (i.e., minimum-maximum) of IN740H listed in Table 1. In at least one embodiment, the FGH process is a fine-grain casting method which employs a low pouring temperature with pre-heated molds during VIM to refine the grain size of the as-cast solidified article. In addition to the physical development of a fine-grain cast structure in the article from the melt-solidification approach, a computationally optimized homogenization technique specifically designed for the NiCrCoAlTi superalloy is also utilized to ensure homogeneous chemical distribution of the hard to diffuse elements of this chemistry throughout the as-cast article.

TABLE 1

| Element | Cr | Co | Al | Ti | Nb | Fe | C | Mn | Mo | Si | Cu | P | s | B | NI |
|---|---|---|---|---|---|---|---|---|---|---|---|---|---|---|---|
| Minimum | 23.5 | 15.0 | 0.2 | 0.5 | 0.5 | — | 0.005 | — | — | — | — | — | — | 0.0006 | Bal. |
| Nominal | 24.5 | 20 | 1.35 | 1.35 | 1.5 | | 0.03 | | 0.1 | 0.15 | | | | | |
| Maximum | 25.5 | 22.0 | 2.0 | 2.5 | 2.5 | 3.0 | 0.08 | 1.0 | 2.0 | 1.0 | a.so | 0.03 | 0.03 | 0.006 | — |

In according to one embodiment, the constituent elements of an alloy are combined using high-purity, industrial-grade metal/alloy for a solidified article target mass of ~7 kg (although article size is not a constraining condition). Chromium may be added as part of master alloys consisting of Ni-25Cr, Ni-30Co-30Cr and/or Ni-30Cr in order to reduce the overall oxygen concentration in the alloys as the raw Cr used for alloy manufacture contained 5200 ppm oxygen. The master alloys were previously melted using a two-step process of VIM followed by ESR to obtain ~68 kg ingots (again, article size is not a constraining condition). This results in a reduction in oxygen concentration and sulfur concentration by reducing the density of non-metallic inclusions. It should be appreciated that various starting material combinations may be used as feed stock for embodiments of the invention and are again not a constraining condition.

The feed stock materials constituting the Ni-based superalloy, NiCrCoAlTi superalloy for example, are loaded in a crucible, a zirconia crucible for example, inside a vacuum induction furnace (VIM). The liquid metal was subsequently poured into a graphite mold to solidify as a cylinder 100 mm in diameter for example. To limit excess carbon pickup in the mold, a zirconia wash coat was used in the mold as a barrier between the liquid metal and the graphite mold walls. The mold was preheated to 500° C. prior to being placed in the VIM furnace. To maintain mold temperature, the graphite mold with zirconia wash coat was wrapped in fiberglass insulation to slow the cooling rate of the mold.

Pouring was initiated when the liquid metal was thoroughly molten and a few degrees above the NiCrCoAlTi superalloy melting temperature as determined by visually observing the viscosity of the liquid and color of the melt pool.

The as-cast article was homogenized in a vacuum heat treatment furnace using a computationally optimized homogenization heat treatment cycle. The homogenization cycle leads to a controlled and random dispersal of the alloy constituents that significantly reduces chemical segregation within the as-cast article. The homogenization heat treatment for the NiCrCoAlTi superalloy leads to specific element segregation below ±1% variation from the nominal chemistry of these elements throughout the article. For the NiCrCoAlTi superalloy casting, the cycle sequence includes about 1 hour at about 1075° C.+about 3 hours at about 1125° C.+about 8 hours at about 1200° C.+about 8 hours at about 1250° C. is used.

The as-homogenized article was subjected to an aging heat treatment consisting of 16 hours at 800° C.

One or more embodiments includes a homogenization heat treatment based on the scale of the microstructure which is dependent upon the thickness of the cast article. The preferred embodiment incorporates a heat treatment to limit residual inhomogeneity to <10%, or more preferable to <5% or more preferable to <1% as described in TABLES 2 and 3. Furthermore, it should be appreciated that commercial heat treatment facilities may be limited to the maximum temperature available. Typical maximum temperatures are 1200° C. and 1250° C. Table X describes treatments at both of these maximum temperatures.

TABLE 2

| Maximum Temperature 1250° C. | | | |
|---|---|---|---|
| Section Size | <10% | <5% | <1% |
| Up to 5 in | 1075 C./1 h + 1125 C./3 h + 1200 C./6 h | 1075 C./1 h + 1125 C./3 h + 1200 C./8 h | 1075 C./1 h + 1125 C./3 h + 1200 C./8 h + 1250 C./8 h |

TABLE 2-continued

| Maximum Temperature 1250° C. | | | |
|---|---|---|---|
| Section Size | <10% | <5% | <1% |
| 5-8 inch | 1075 C./1 h + 1125 C./3 h + 1200 C./8 h + 1250 C./8 h | 1075 C./1 h + 1125 C./3 h + 1200 C./8 h + 1250 C./12 h | 1075 C./1 h + 1125 C./3 h + 1200 C./8 h + 1250 C./24 h |
| >8 inch | 1075 C./1 h + 1125 C./6 h + 1200 C./8 h + 1250 C./16 h | 1075 C./1 h + 1125 C./6 h + 1200 C./8 h + 1250 C./26 h | 1075 C./1 h + 1125 C./6 h + 1200 C./8 h + 1250 C./50 h |

TABLE 3

| Maximum Temperature 1200° C. | | | |
|---|---|---|---|
| Section Size | <10% | <5% | <1% |
| Up to 5in | 1075 C./1 h + 1125 C./3 h + 1200 C./6 h | 1075 C./1 h + 1125 C./3 h + 1200 C./8 h | 1075 C./1 h + 1125 C./3 h + 1200 C./30 h |
| 5-8 inch | 1075 C./1 h + 1125 C./3 h + 1200 C./24 h | 1075 C./1 h + 1125 C./3 h + 1200 C./36 h | 1075 C./1 h + 1125 C./3 h + 1200 C./65 h |
| >8 inch | 1075 C./1 h + 1125 C./6 h + 1200 C./40 h | 1075 C./1 h + 1125 C./6 h + 1200 C./60 h | 1075 C./1 h + 1125 C./6 h + 1200 C./110 h |

Figure 2:
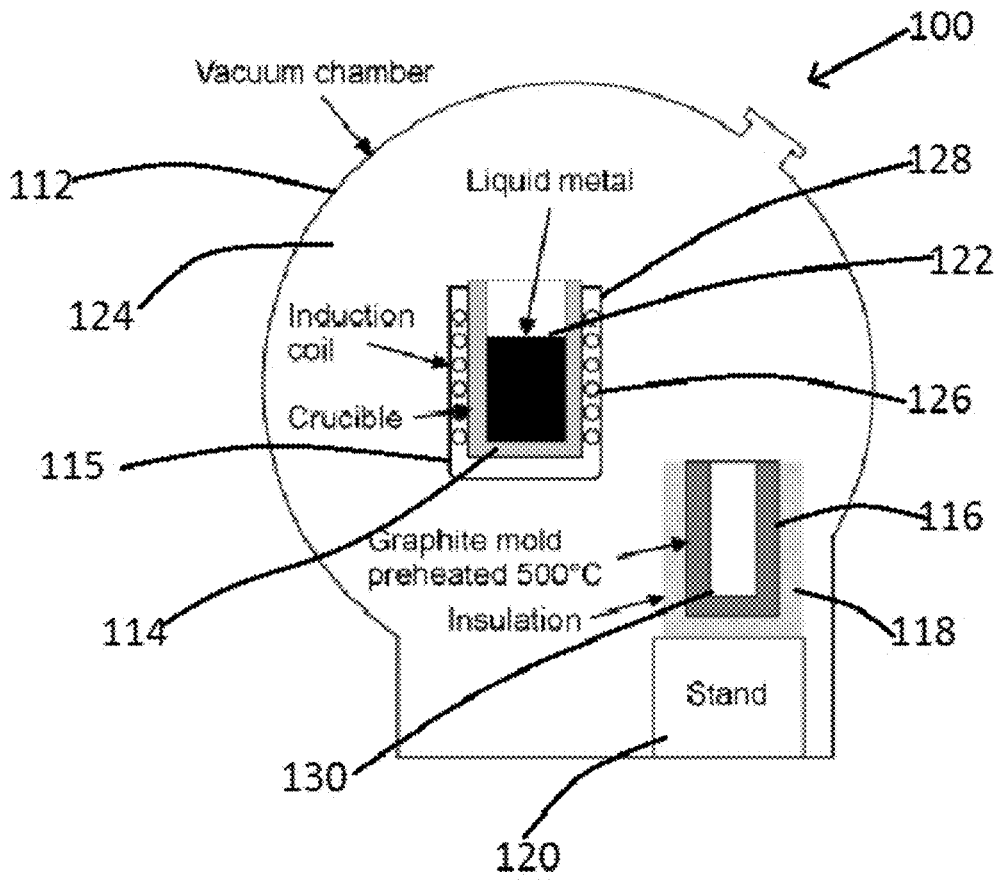
FIG. 2 depicts a representation of a fine grain casting system in accordance with one embodiment, illustrating a melting step.

FIG. 2 depicts a representation of a fine grain casting system, generally designated 100, in accordance with one embodiment. FIG. 2 specifically depicts the melting step. The system 100 includes a furnace 112, a VIM furnace for example, defining a vacuum chamber 124 having a crucible 114. In the illustrated embodiment, the crucible 114 is positioned in a melt box 115 where it is wrapped in a sleeve 128 including induction coils 126.

As depicted, furnace 112 further includes a mold 116, a graphite mold, wrapped in insulation 118, fiberglass insulation for example, on stand 120. The system 100 illustrates liquid metal 122, adaptable to be poured into mold 116.

Figure 3:
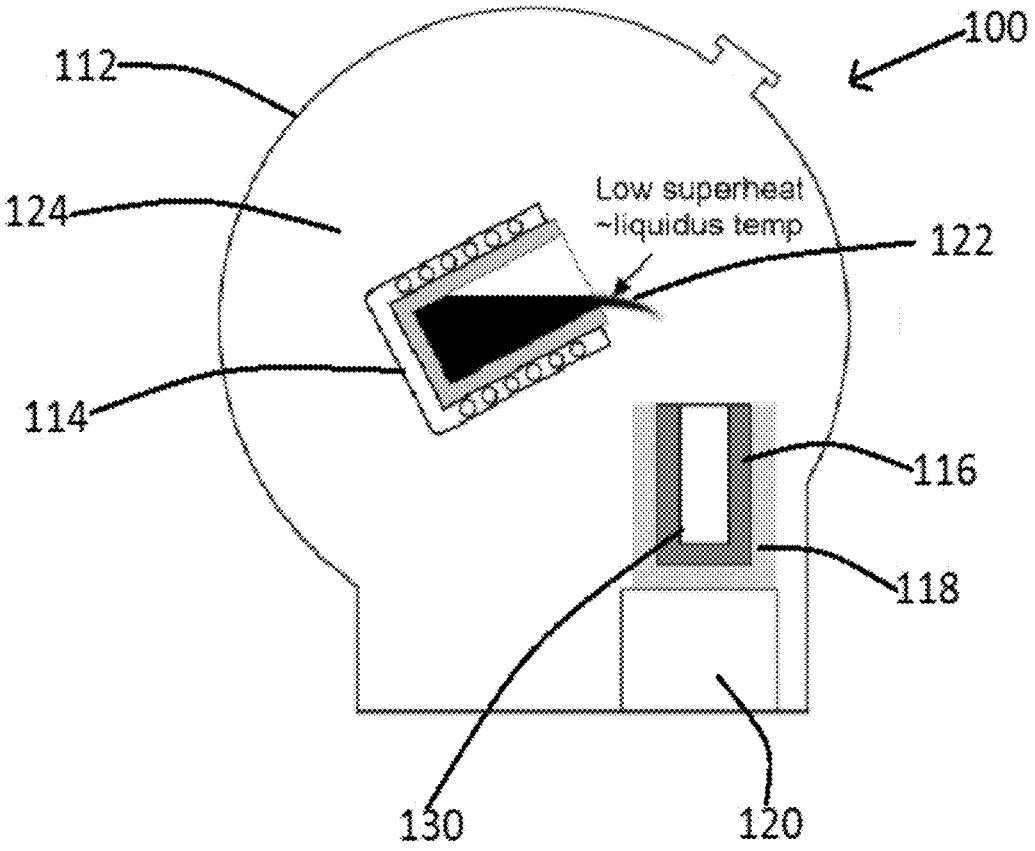
FIG. 3 depicts a representation of a fine grain casting system in accordance with one embodiment, illustrating a pouring step.
Figure 4:
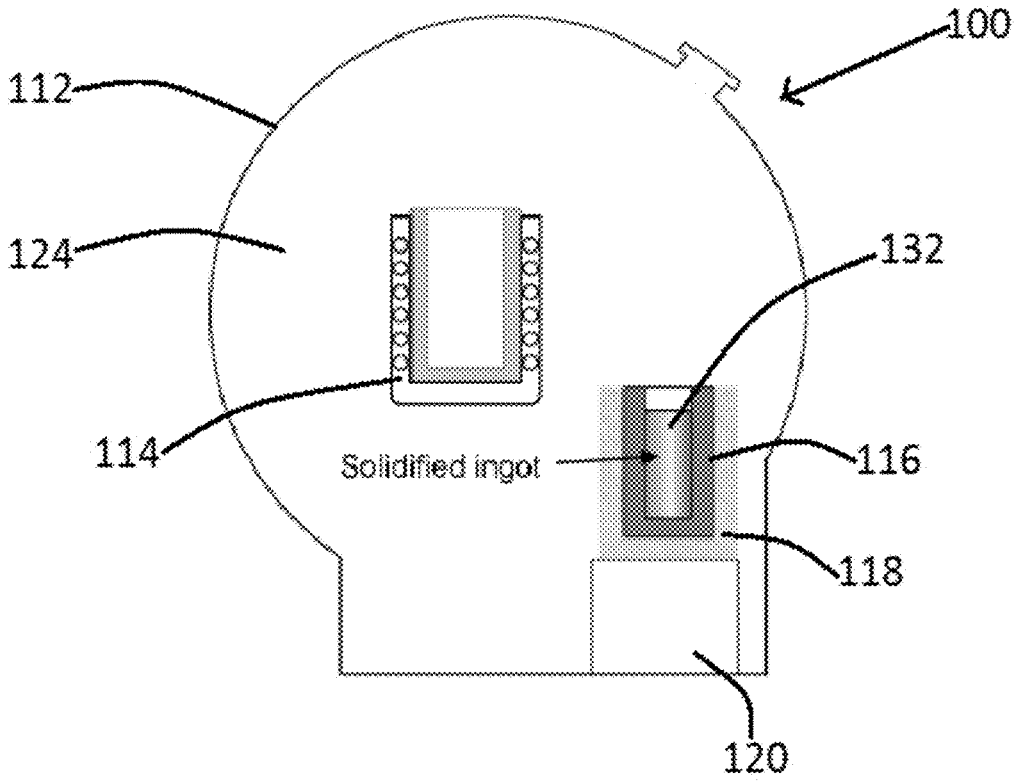
FIG. 4 depicts a representation of a fine grain casting system in accordance with one embodiment, illustrating a solidification step.

FIG. 3 the fine grain casting system 100 in accordance with one embodiment, illustrating a pouring step. FIG. 4 depicts a representation of a fine grain casting system 100 illustrating a solidification step forming ingot 132.

In one or more embodiments feed stock materials constituting a Ni-based superalloy, a NiCrCoAlTi superalloy for example, are cast into the Ni-based superalloy of predetermined shape, an ingot with for example, using the system 100. In one or more embodiments, the feed stock comprises Nickel (Ni) and at least one of Chromium (Cr), Cobalt (Co), Aluminum (Al), Titanium (Ti), Niobium (Nb), Iron (Fe), Carbon (C), Manganese (Mn), Molybdenum (Mo), Silicon (Si), Copper (Cu), Phosphorus (P), Sulfur (S) and Boron (B). In one embodiment, the feed stock comprises Nickel (Ni) and Chromium (Cr).

The feed stock is loaded in the crucible 114, a zirconia crucible, inside the furnace 112, a vacuum induction furnace or VIM for example, forming a loaded feed stock. The feed stock melts in the furnace 112, forming a liquid metal 122.

The liquid metal 122 is poured into a graphite mold 116 to solidify (as a cylinder 100 mm in diameter for example). To limit excess carbon pickup in the mold, a zirconia wash coat 130 was used in the mold 116 as a barrier between the liquid metal and the graphite mold walls. The mold 116 was preheated to 500° C. prior to being placed in the VIM furnace. To maintain mold temperature, the graphite mold 116 with zirconia wash coat 130 was wrapped in fiberglass insulation 118 to slow the cooling rate of the mold.

One or more embodiments described herein includes a method of casting a creep-resistant Ni-based superalloy. The method includes forming a feed stock and fabricating an as-cast article comprising creep-resistant Ni-based superalloy in a predetermined shape. The feed stock includes Nickel (Ni) and at least one of Chromium (Cr), Cobalt (Co), Aluminum (Al), Titanium (Ti), Niobium (Nb), Iron (Fe), Carbon (C), Manganese (Mn), Molybdenum (Mo), Silicon (Si), Copper (Cu), Phosphorus (P), Sulfur (S) and Boron (B). fabricating an as-cast article includes using the feed stock and at least one process comprising vacuum induction melting (VIM), electroslag remelting (ESR) and/or vacuum arc remelting (VAR). In at least one embodiment, the feed stock comprises at least Nickel (Ni) and Chromium (Cr).

One embodiment includes melting the feed stock in a furnace, forming a liquid metal, pouring the liquid metal into a preheated mold, forming a molten metal; and solidifying the molten metal in the preheated mold, forming the as-cast article.

One or more embodiments includes homogenizing the as-cast article in a vacuum heat treatment furnace using a computationally optimized homogenization heat treatment cycle, forming a controlled and random dispersal of alloy constituents that significantly reduces chemical segregation within the as-cast article. Homogenizing the as-cast article forms a specific element segregation below ±1% variation from the nominal chemistry of these elements throughout the as-cast article. Homogenizing the as-cast article may include a sequence of heating or treatment including one hour at about 1075° C., three hours at about 1125° C., eight hours at about 1200° C. and eight hours at about 1250° C.

In one or more embodiments, melting the feed stock is carried out in at least one of a vacuum and at a partial pressure between 50 and 400 Torr of Argon (Ar). Additionally, melting the metal Ni-based superalloy may include pouring the liquid metal into the crucible when the temperature of the liquid metal is between 1 and 10 degrees Celsius above the melting temperature of the loaded feed stock.

Preheating the mold may include heating the mold from between about 300° C. to about 700° C. from about 10 minutes to about 5 hours.

In one or more embodiments, the cast alloy is subjected to a homogenization heat treatment comprising at least two of the sequential steps of treating the cast alloy: 0.5 to 5 hours at 1075±25° C.; 1.5 to 3 hours at 1125±25° C.; 3 to 15 hours at 1200±25° C.; 3 to 24 hours at 1250±25° C. The cast alloy is characterizable by a level of chemical homogeneity, defined as variations between local and nominal chemistry following homogenizing and measured using wavelength dispersive x-ray fluorescence, of less than ±1%, or less than ±2%, or less than ±5%.

Figure 5:
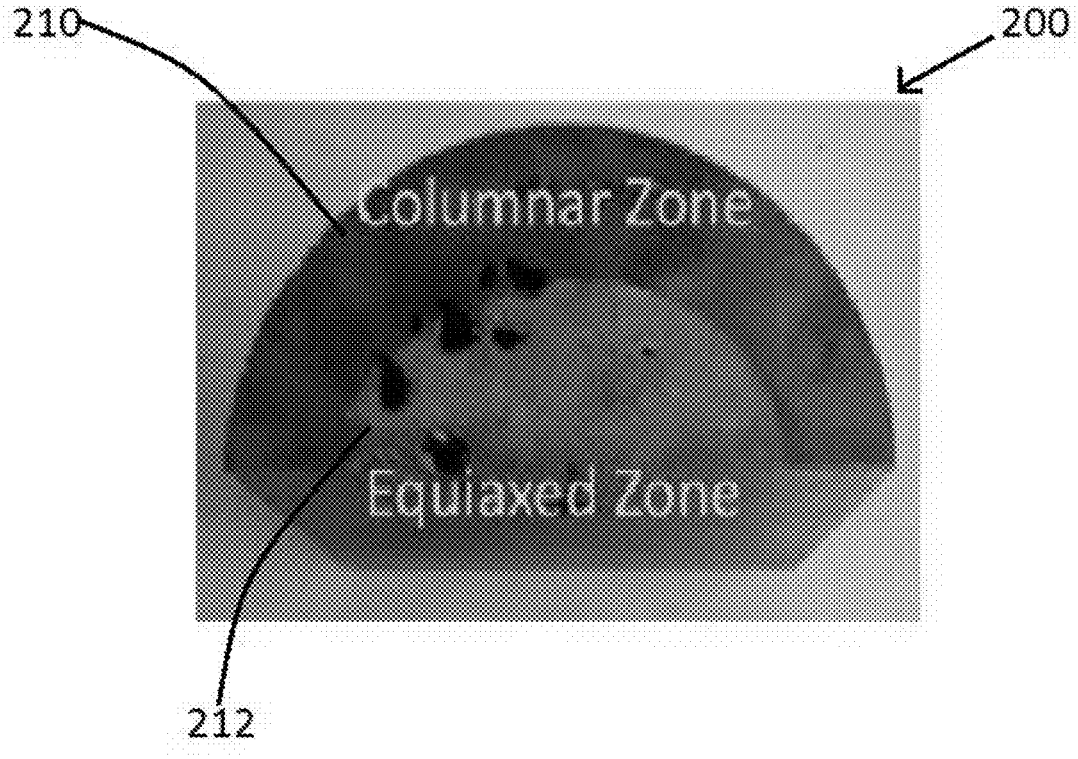
(Prior Art) FIGURE 5
FIG. 5 depicts an end view of an ingot formed using prior art sectioned in half.
Figure 6:
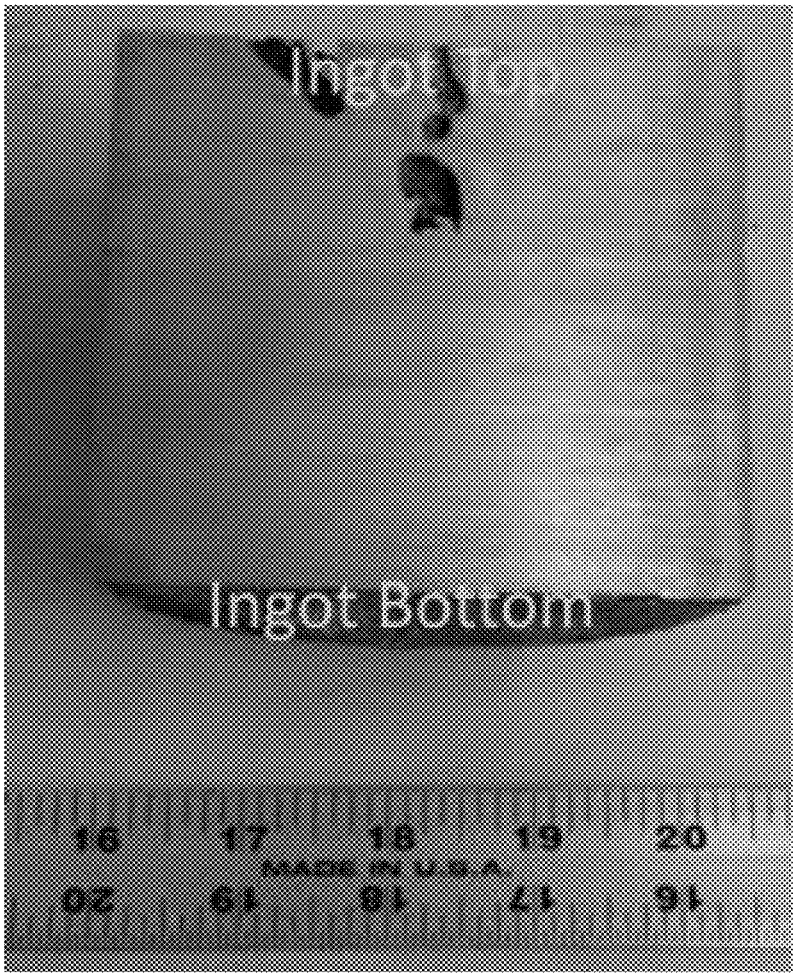
(Prior Art) FIGURE 6
FIG. 6 depicts a side view of an ingot formed using prior art sectioned in half.

FIG. 5 depicts an end view of an ingot 200 sectioned in half formed using conventional techniques. FIG. 5 depicts the ingot 200 a large columnar zone 210 that transitions to an equiaxed grain structure zone 212. FIG. 6 depicts an elevational view of an ingot 300 sectioned in half formed using conventional techniques similar to that of ingot 300.

Figure 7:
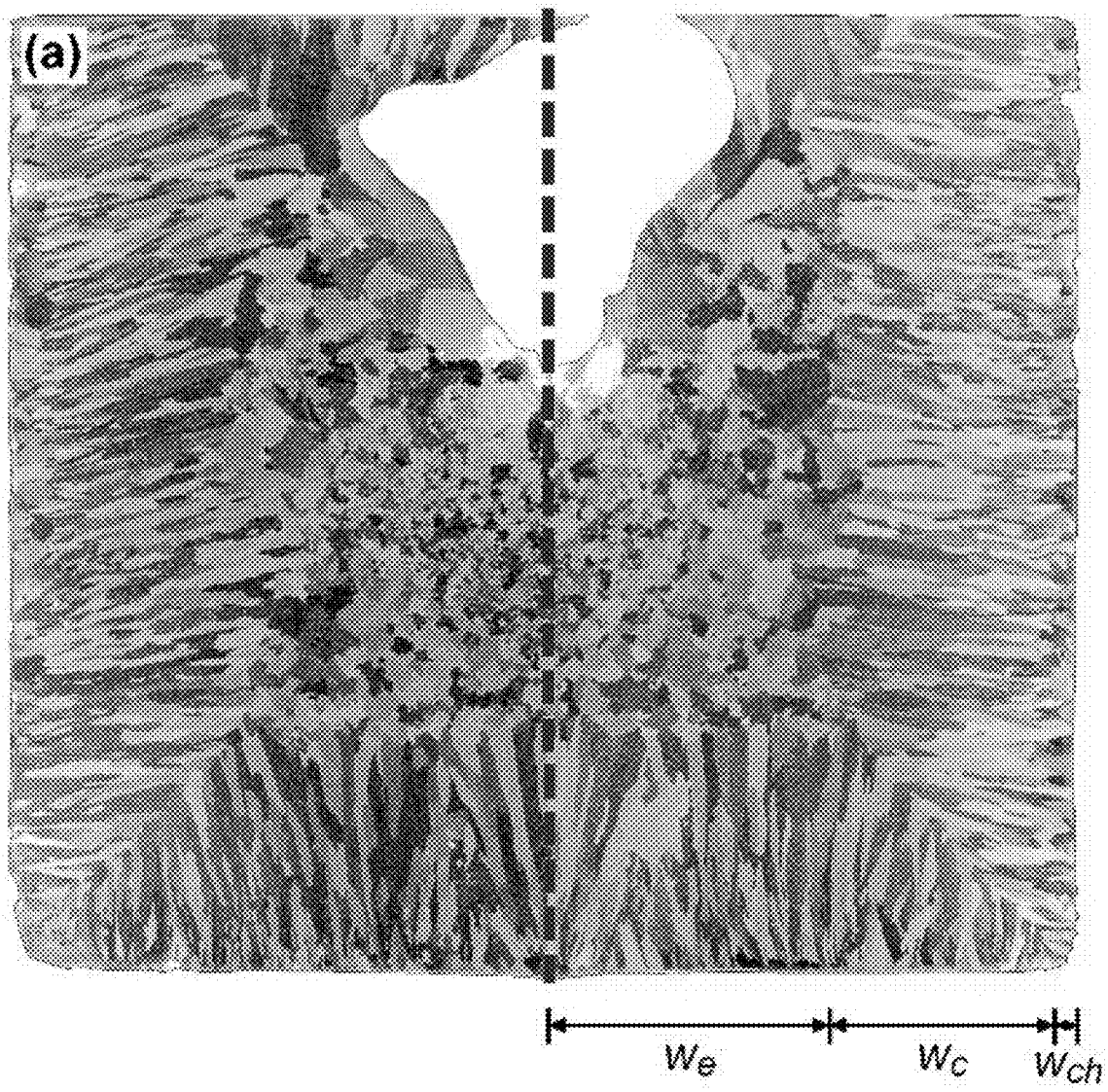
(Prior Art) FIGURE 7
FIG. 7 depicts an image representing the macrostructure of a conventionally cast ingot sectioned in half.
Figure 8:
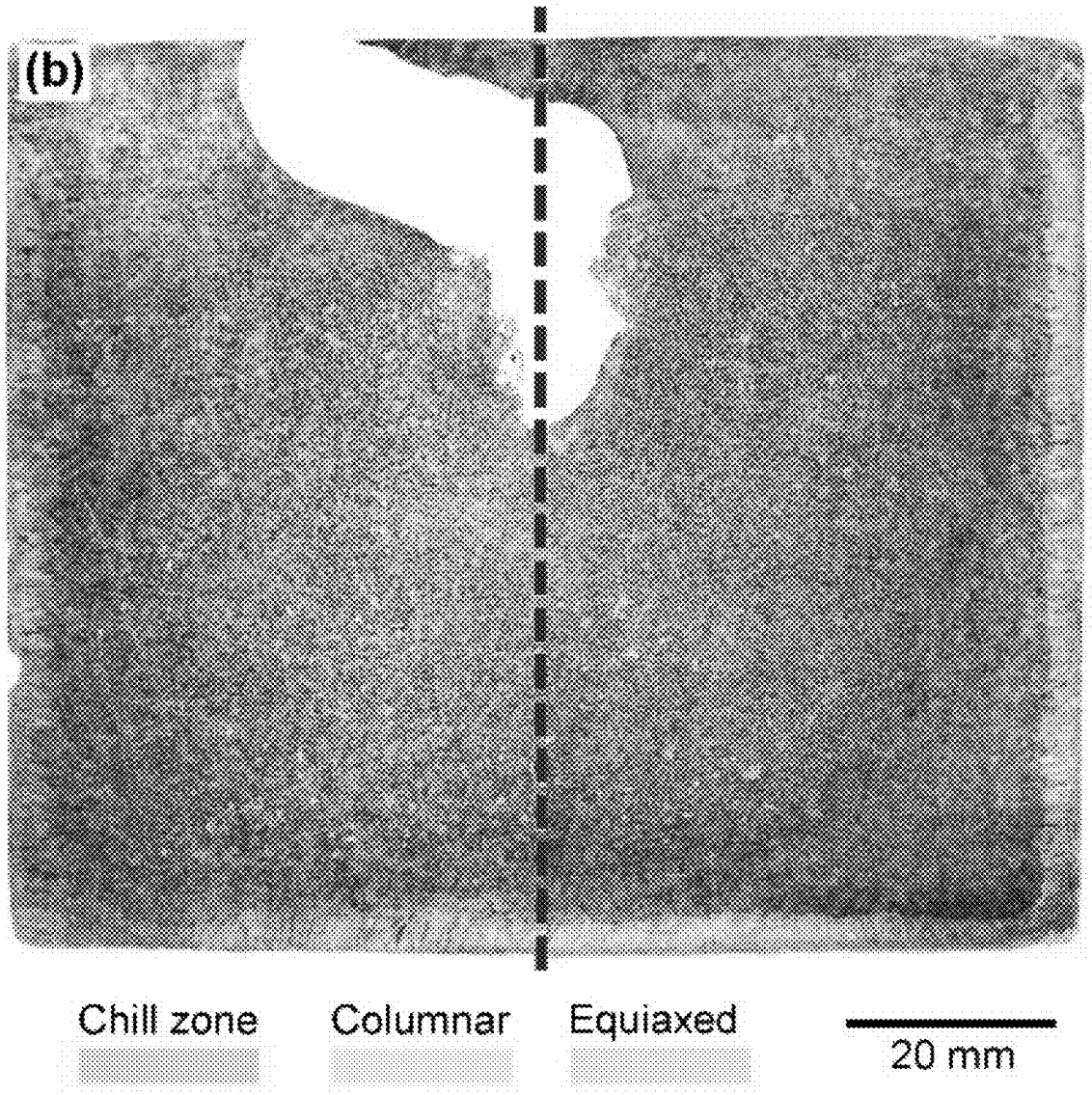
FIG. 8 represents the macrostructure of an ingot formed using one embodiment of the present invention.

FIGS. 7 and 8 represent the macrostructure of conventional and FGH ingots sectioned in half. FIG. 7 illustrates the typical macrostructure of a conventionally cast ingot. A small chill zone appears on the sides and bottom where the liquid metal first contacted the mold. A large columnar zone is observed next that transitions to an equiaxed grain structure in the middle of the ingot. FIG. 8 illustrates the macrostructure of an ingot formed using one or more embodiments of the present invention (referred to as a FGH article). In FIG. 8, the chill zone was reduced and, more importantly, the columnar zone was significantly reduced in thickness (and volume) in comparison to the conventional cg. This results in most of the as-cast article having a more desirable fine-grained equiaxed microstructure. Moreover, the grain size in the equiaxed region was considerably reduced in comparison to the conventional casting. This approach resulted in a grain structure that was considerably more homogeneous physically and as chemically compared to the conventional casting.

TABLE 4 illustrates the composition of castings from XRF Analysis (wt. %). Tensile and creep testing were systematically performed on these articles as well as for the FGH article following homogenization and aging heat treatments. Six (6) conventional castings were selected for inclusion in TABLE 4 for comparison to the FGH article. It should be noted that the conventional castings were also homogenized using the same computationally optimized heat treatment schedule as was used for the FGH article.

While the standard aging treatment consisted of 16 hours at 800° C. Two additional aging heat treatments were investigated for alloys L2B, L2C and L2LC. The first alternate aging heat treatment consisted of heating the ingots to 850° C. for 4 hours followed by lowering the temperature to 800° C. for an additional 8 hours. These aged articles were then allowed to cool to room temperature in air. The second alternate aging heat treatment was to soak the as-cast (and homogenized) articles at 950° C. for 2 hours followed by 8 hours at 800° C. Following the aging cycle, the articles were once again cooled to room temperature in air. It should be appreciated that conventionally cast articles B, L1B and L2B contained La. This was used to reduce the S content.

TABLE 4

| | Ni | Cr | Co | Al | Ti | Nb | Fe | C* | Mn | Mo | Si | B** | La |
|---|---|---|---|---|---|---|---|---|---|---|---|---|---|
| B | Bal. | 24.8 | 19.6 | 1.24 | 1.33 | 1.49 | 2.47 | 0.03 | 0.31 | 0.5 | 0.14 | | ~0.01 |
| L1B | Bal. | 23.7 | 17.9 | 0.74 | 1.12 | 1.30 | — | 0.03 | 0.10 | 2.0 | 0.07 | 0.0010 | 0.023 |
| L2B | Bal. | 24.1 | 16.4 | 1.03 | 1.49 | 1.30 | — | 0.03 | 0.11 | 2.0 | 0.06 | 0.0008 | 0.023 |
| L2C | Bal. | 23.8 | 18.2 | 1.14 | 1.48 | 1.29 | 0.64 | 0.03 | 0.10 | 2.0 | 0.18 | 0.0050 | — |
| L2LC | Bal. | 23.6 | 18.0 | 1.03 | 1.52 | 1.30 | 0.08 | 0.02 | 0.10 | 2.0 | 0.05 | 0.0006 | — |
| L3 | Bal. | 24.1 | 20.2 | 1.40 | 2.49 | 0.49 | — | 0.03 | 0.10 | 2.0 | 0.07 | 0.0011 | — |
| FGH | Bal. | 24.4 | 19.6 | 1.15 | 1.53 | 1.58 | — | 0.03 | 0.32 | 0.5 | 0.21 | 0.0011 | — |

Table 5 compiles various measurements obtained from the macrostructures illustrated in FIGS. 7 and 8. The conventional casting approach for these alloys resulted in the commonly observed macrostructure zone ratio seen in FIG. 7. The chill zone width was limited to approximately 2 mm. A large, columnar zone next formed, which was approximately 21 mm in thickness, as measured from each surface of the mold. The last region to form was the central equiaxed zone spanning a radius of 27 mm from the cylindrical article centerline. This zone started ~23 mm from the bottom mold surface.

In FIG. 8, the equiaxed zone of the FGH casting was significantly greater than that in the conventional casting. The equiaxed zone extended from about 48 mm from the centerline of the cylindrical article with the chill/columnar zone ~4 mm from the mold bottom surface. Both the columnar and chill zone thicknesses were greatly reduced, i.e., 3 mm for the columnar zone and 0.6 mm for the chill zone, representing an 86% and 72% reduction, respectively, from the average of the conventional cast articles.

The average grain size in the equiaxed regions were calculated to be 717±101 μm for the conventionally as-cast articles as compared to 289±42 μm for the FGH as-cast article. Overall, the grain size was significantly more homogeneous (i.e., the physical grain structure) in the FGH as-cast article than in the conventionally as-cast article, which had grain sizes ranging from approximately 40 μm to greater than 4,000 μm.

TABLE 5

| | Conventional Casting | Fine-Grain Casting |
|---|---|---|
| We: Equiaxed Width (mm)* | 27.1 ± 1.2 | 48.1 ± 0.4 |
| Wc: Columnar Width (mm)* | 20.8 ± 1.0 | 2.9 ± 0.3 |
| Wch: Chill Zone Width (mm)* | 2.0 ± 0.7 | 0.6 ± 0.1 |
| Average Grain Size in the Equiaxed Zone (μm)** | 717 ± 101 | 289 ± 42 |

*Standard deviations reported over 12 equally spaced measurements along the ingot centerline.
**Standard deviations reported over 8 randomly drawn lines (linear intersect technique).

Figure 9:
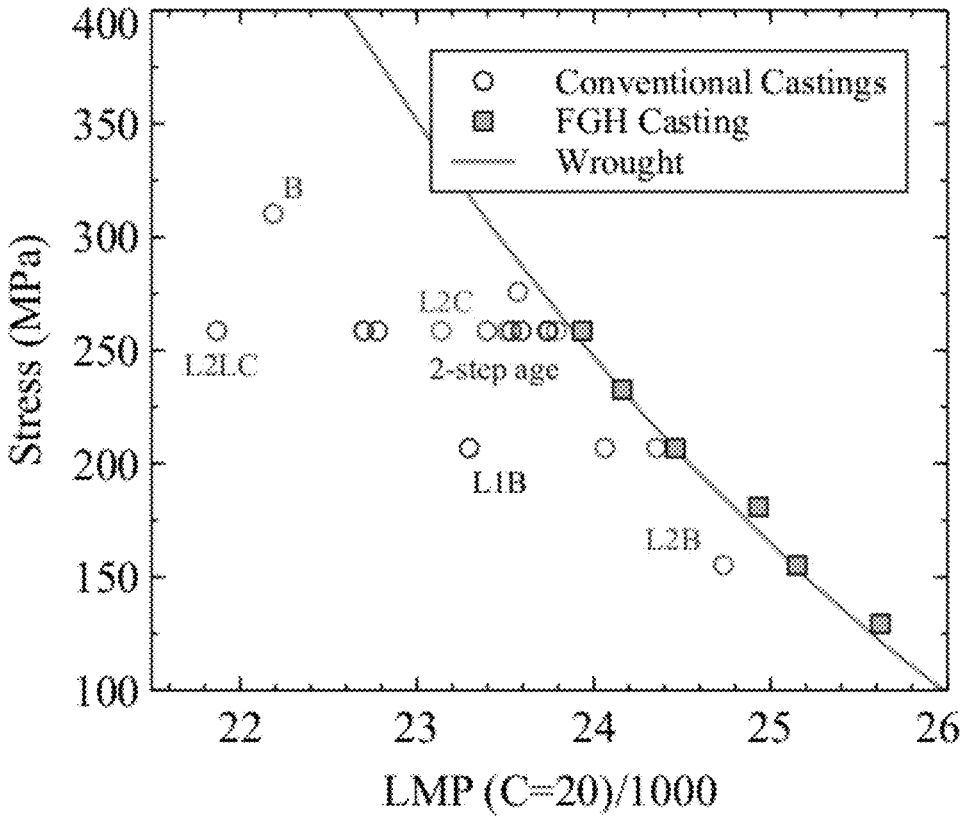
FIG. 9 depicts a graph illustrating creep properties of various ingots represented as data points on a Larson-Miller Parameter (LMP) plot and compared to the LMP curve for the wrought product.

FIG. 9 depicts the creep properties of the various ingots represented as data points on a Larson-Miller Parameter (LMP) and are compared to the LMP curve for the wrought product, IN740H, (i.e., solid line representing a trendline of the wrought data) at 775° C. Various specimens were tested from six (6) of the castings listed in TABLE 4 under different stresses and temperatures. For convenience, the creep results (with additional information) are also listed in TABLE 6. Data from the conventional castings show significant scatter with data points predominantly located to the left of the IN740H mean LMP trendline curve. Alloy L2B appeared to outperform the other conventional castings with the exception of the 760° C./259 MPa creep test. It should be noted that the scatter was also present when testing the same alloy under identical conditions, as shown in TABLE 6 where three specimens from L2C were tested at 760° C./259 MPa. The results show times to failure of 250, 575 and 1069 hours. The two-step aging heat treatment increased the times to failure when compared to the standard aging treatment, particularly for alloys L2B and L2LC.

The FGH articles were tested under six (6) different stresses and two temperatures to obtain an LMP curve (data points in FIG. 9) and ensure statistical evidence when reporting the creep properties. Two different temperatures were considered, and the full list of testing parameters are shown in TABLE 6.

The data for the six (6) tests fall on the wrought curve, or just slightly beyond it. The shortest test was performed at 790° C./233 MPa and lasted 536 hours while the longest test was obtained at 760° C./207 MPa which lasted 12,732 hours.

TABLE 6

| Alloy | Temperature (° C.) | Stress (MPa) | Time to Failure (h) | LMP (C = 20)/1000 | Elongation to Failure (%) |
|---|---|---|---|---|---|
| B | 735 | 310 | 103 | 22.19 | 0.2 |
| | 760 | 259 | 446 | 23.40 | 2.9 |
| | 785 | 207 | 555 | 24.06 | 1.0 |
| LIB | 775 | 207 | 169 | 23.29 | 1.9 |
| L2B | 800 | 276 | 93 | 23.57 | 5.2 |
| | 760 | 259 | 94 | 22.70 | 2.7 |
| | 775 | 207 | 1,739 | 24.36 | 2.1 |
| | 790 | 155 | 1,855 | 24.73 | 1.5 |
| L2B* | 760 | 259 | 966 | 23.74 | 2.4 |
| L2B** | 760 | 259 | 954 | 23.74 | 2.2 |
| L2C | 760 | 259 | 250 | 23.14 | 2.2 |
| | 760 | 259 | 575 | 23.51 | 2.1 |
| | 760 | 259 | 1,069 | 23.79 | 1.7 |
| L2C* | 760 | 259 | 907 | 23.72 | 3.7 |
| L2C** | 760 | 259 | 685 | 23.59 | 6.4 |
| L2LC | 760 | 259 | 15 | 21.87 | 0.04 |
| L2LC* | 760 | 259 | 95 | 22.70 | 0.04 |
| L2LC** | 760 | 259 | 112 | 22.78 | 0.08 |
| FGH | 760 | 259 | 1,479 | 23.93 | 1.4 |
| | 790 | 233 | 536 | 24.16 | 1.6 |
| | 760 | 207 | 4,806 | 24.46 | 0.92 |
| | 790 | 181 | 2,845 | 24.93 | 0.95 |
| | 760/790*** | 155 | 4,571 | 25.15 | 0.35 |
| | 790 | 129 | 12,732 | 25.62 | 1.3 |

*Aged using the 2-step heat treatment 850° C. for 4 hours followed by 800° C. for 8 hours.
**Aged using the 2-step heat treatment 950° C. for 2 hours followed by 800° C. for 8 hours.
***Test started at 760° C., stopped after 8,896 hours and restarted at 790° C. to accelerate.

Figure 10:
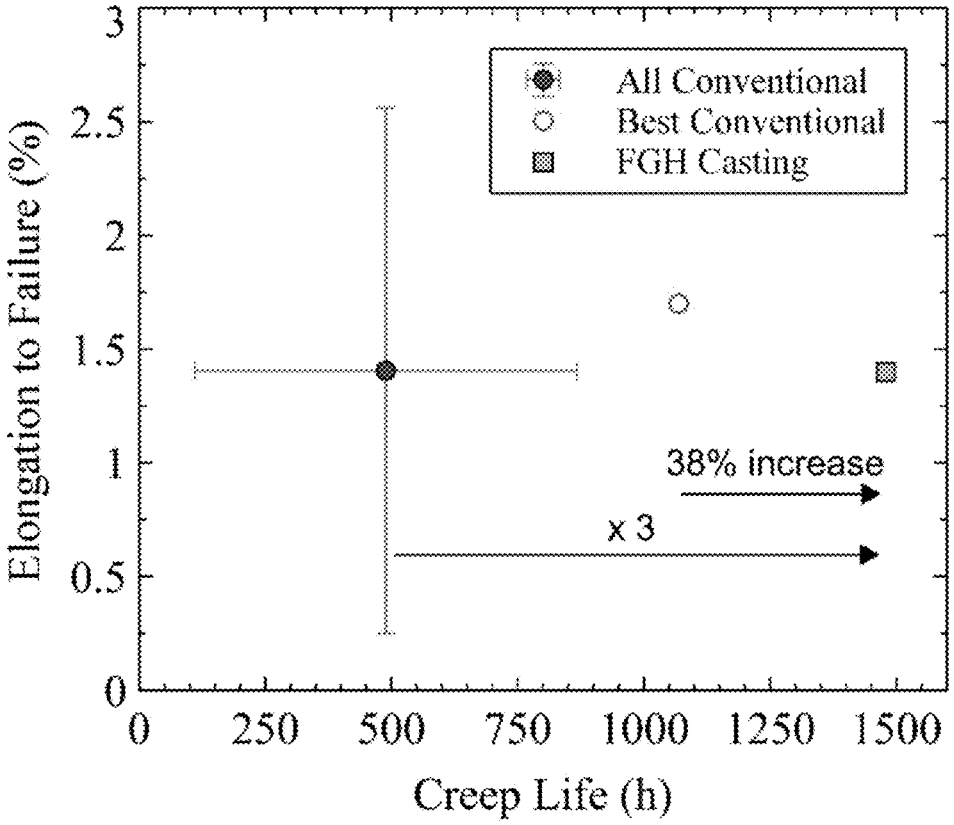
FIG. 10 depicts a graph illustrating the comparison of creep tests at 259 MPa and 760° C. between conventional and FGH castings (present invention) in the form of creep strain as a function of creep life.

A comparison of the creep tests at 259 MPa and 760° C. between the conventional and the FGH castings is shown in the graph illustrated in FIG. 10 in the form of creep strain as a function of creep life. The average results for all conventional castings resulted in a value of elongation to failure in creep of approximately 1.4% with a creep life of 489 hours. Comparatively, while the elongation to failure in creep for the FGH casting remains relatively the same, the increase in creep life is significantly greater, reaching 1,479 hours, a more than three-fold increase of the average of all conventional castings. Meanwhile, the best performing conventionally cast specimen (i.e., in terms of creep life) reached a slightly higher value for elongation to failure in creep of 1.7%. However, the time to failure, while high for the conventionally cast ingots, remained lower at 1,069 hours. The creep life of the FGH cast material still outperformed the best conventionally cast specimen by 38%.

Figure 11:
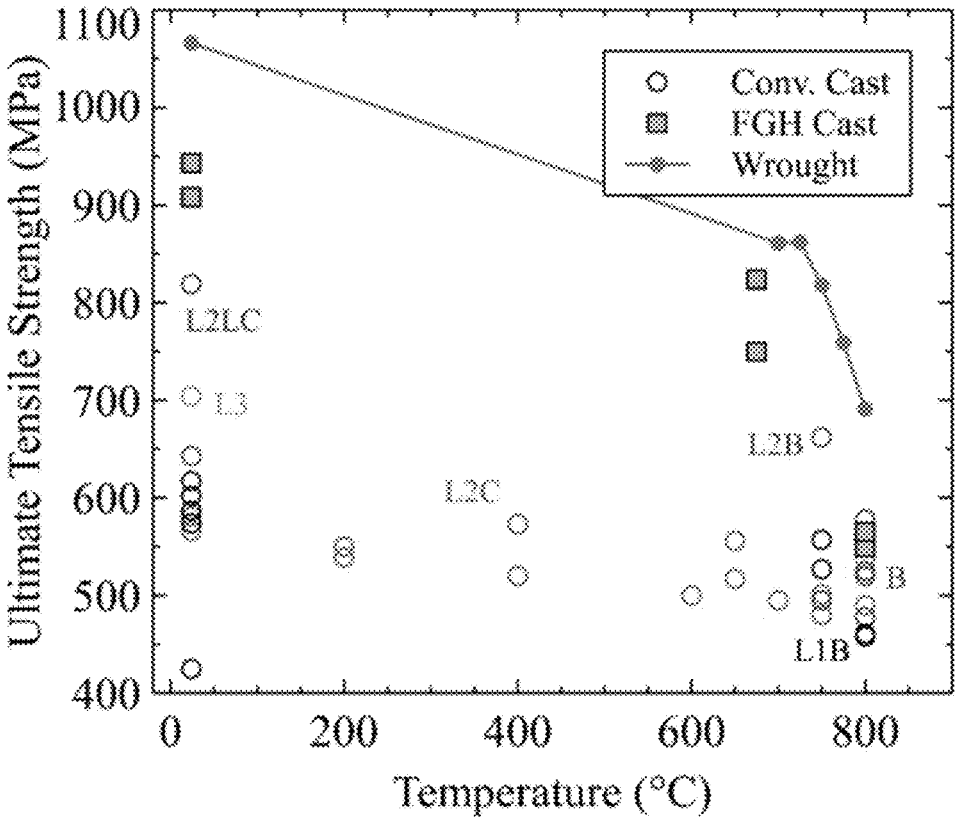
FIG. 11 depicts a graph illustrating results of tensile testing showing the ultimate tensile strength.
Figure 12:
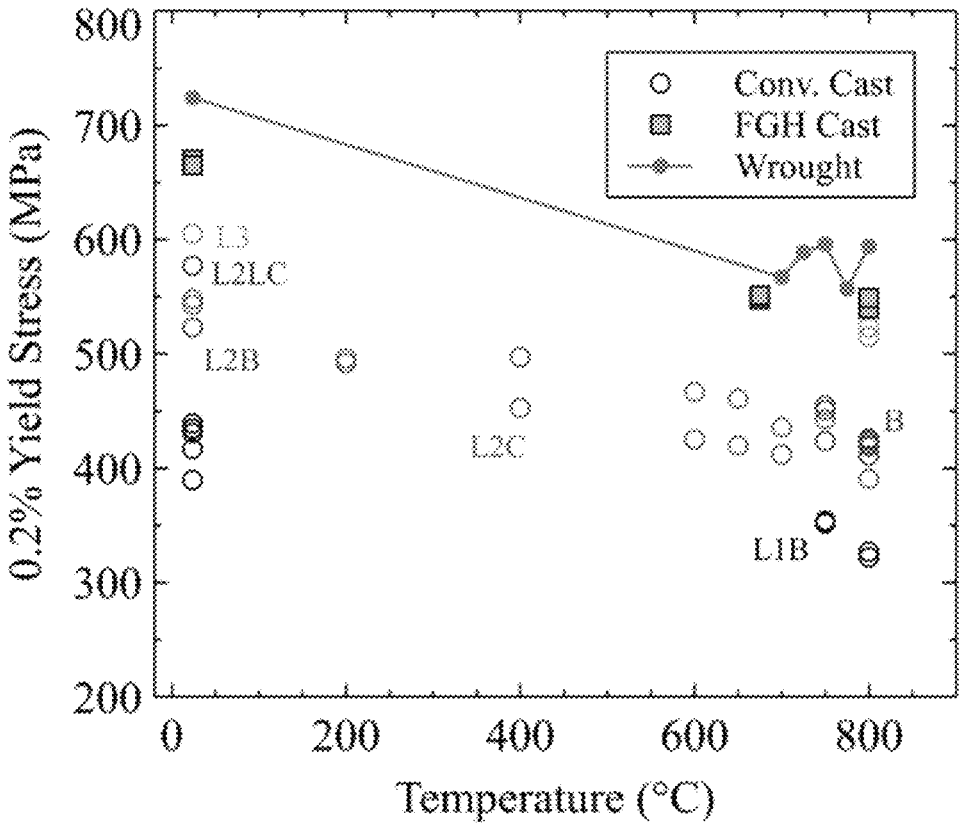
FIG. 12 depicts a graph illustrating results of tensile testing of 0.2% yield stress.
Figure 13:
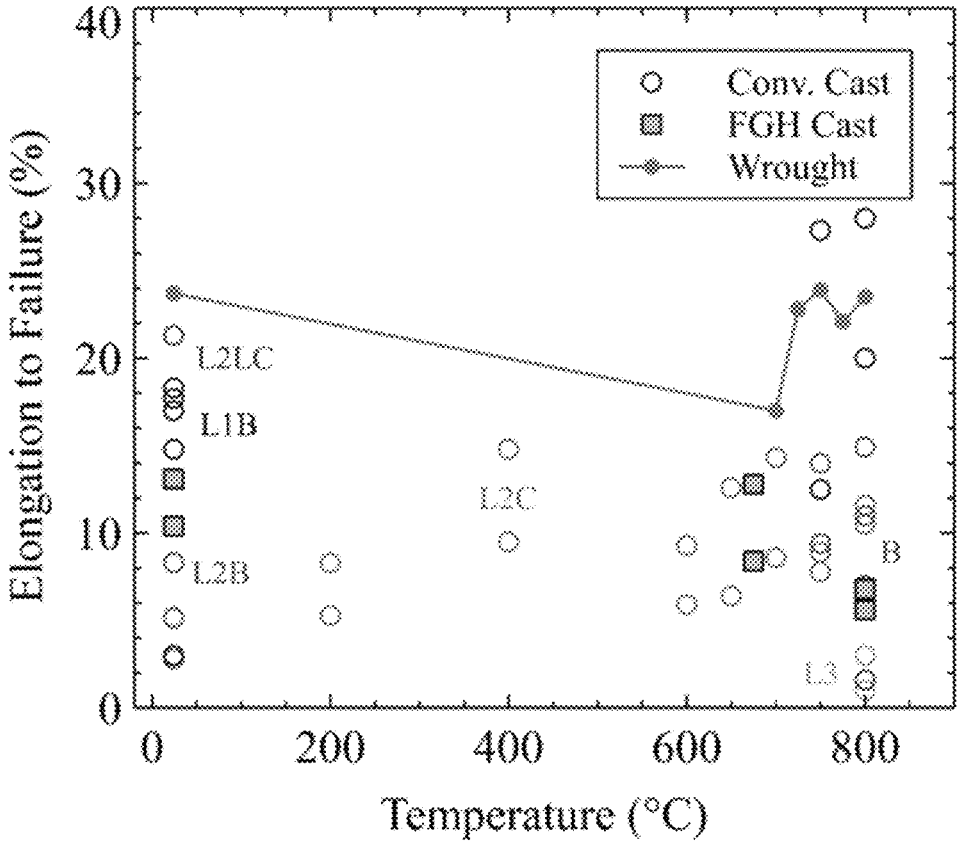
FIG. 13 depicts a graph illustrating results of tensile testing showing the elongation to failure of all conventional castings and the FGH casting (present invention) compared to data from wrought IN740H.

Tensile testing results from all cast specimens are compiled in FIGS. 11-13 and compared to the data reported for the wrought alloy. It should be appreciated that the wrought data corresponds to a product that was extruded, solution annealed at 1120° C. followed by water quenching and aging at 800° C. for 5 hours followed by air cooling. Significant scatter was observed for the conventionally cast articles. Starting with the ultimate tensile strength (UTS) in FIG. 11, conventional casting resulted in UTS between 425 and 819 MPa at room temperature with the highest UTS associated with the low-carbon (L2LC) alloy. This represents an average UTS of 612±101 MPa, significantly lower than that of the FGH articles of 926±25 MPa (minimum of 908 MPa and maximum of 943 MPa). At 675° C., the UTS of the FGH articles was 787±52 MPa while the best performing conventionally cast specimen reached a UTS of 560 MPa. At 800° C., the average UTS of the conventional castings was calculated to be 517±41 MPa while the specimens from the FGH articles resulted in a UTS of 557±11. Overall, the FGH casting approach resulted in UTS values between those from specimens extracted from the conventional castings and the wrought product.

Results of the 0.2% yield stress (YS) shown in FIG. 12 reveal values of the FGH cast articles close to the wrought alloy and significantly greater than those conventionally cast. For instance, at room temperature the average YS of conventionally cast articles was 491±76 MPa, and ranged from 390 MPa for L1B to 605 MPa for L3. Alternatively, the average YS of FGH cast articles was 668±4 MPa. At elevated temperature, the YS of the FGH cast articles was similar to that of the wrought alloy. Average values at 800° C. are 545±6 MPa for the FGH cast samples and 418±62 MPa for the conventionally cast samples. Only alloy L3 reached a YS close to that of the FGH cast material with an average of 519±6 MPa.

Unlike the UTS and YS, the elongation to failure of the FGH cast articles was between values measured on the specimens from the conventional castings, FIG. 13. At room temperature, the average elongation to failure was similar at 11±7% and 12±2% for the conventional and FGH castings, respectively. However, and as the standard deviations suggest, the range for the conventional castings spanned quite a large span in elongation to failure, ranging from 3% to 21%. The latter value is close to the elongation to failure of the wrought product at 24%. Similar trends were observed at elevated temperatures with the average elongation to failure of 10±8% and 6±1% for the conventional and FGH castings at 800° C., respectively. Alloy L1B exhibited an average elongation to failure of 24±6%, which is similar to that of the wrought product.

TABLE 7

| Alloy | Temperature ('C.) | UTS (MPa) | 0.2% Yield Stress (MPa) | Elongation to Failure (%) |
|---|---|---|---|---|
| B | 800 | 525 | 426 | 6.0 |
| | 800 | 520 | 421 | 7.0 |
| LIB | 24 | 574 | 417 | 17.7 |
| | 24 | 425 | 390 | 3.0 |
| | 24 | 602 | 431 | 17.0 |
| | 24 | 587 | 439 | 14.8 |
| | 24 | 617 | 435 | 18.3 |
| | 750 | 557 | 352 | 27.3 |
| | 750 | 527 | 354 | 12.5 |
| | 800 | 461 | 327 | 20.0 |
| | 800 | 458 | 322 | 28.0 |
| L2B | 24 | 643 | 523 | 8.3 |
| | 750 | 495 | 424 | 9.4 |
| | 750 | 662 | 451 | 14.0 |
| | 800 | 578 | 424 | 11.0 |
| | 800 | 558 | 411 | 14.9 |
| L2B* | 24 | 669 | 535 | 6.1 |
| | 800 | 554 | 400 | 8.2 |
| | 800 | 560 | 407 | 8.7 |
| L2B** | 24 | 724 | 528 | 15.0 |
| | 800 | 495 | 405 | 5.2 |
| | 800 | 502 | 406 | 4.6 |
| L2C | 24 | 581 | 543 | 2.8 |
| | 24 | 566 | 548 | 5.2 |
| | 200 | 550 | 496 | 8.3 |
| | 200 | 539 | 492 | 5.3 |
| | 400 | 573 | 497 | 9.5 |
| | 400 | 520 | 453 | 14.8 |
| | 600 | 127 | 467 | 5.9 |
| | 600 | 500 | 425 | 9.3 |
| | 650 | 517 | 420 | 12.6 |
| | 650 | 556 | 461 | 6.4 |
| | 700 | 285 | 436 | 8.6 |
| | 700 | 495 | 412 | 14.3 |
| | 750 | 480 | 443 | 7.8 |
| | 750 | 501 | 455 | 8.9 |
| | 800 | 562 | 419 | 11.6 |
| | 800 | 490 | 391 | 10.5 |
| L2C* | 24 | 552 | 509 | 3.7 |
| | 800 | 581 | 427 | 6.4 |

TABLE 7-continued

| Alloy | Temperature ('C.) | UTS (MPa) | 0.2% Yield Stress (MPa) | Elongation to Failure (%) |
|---|---|---|---|---|
| L2C** | 24 | 654 | 557 | 9.4 |
| | 800 | 458 | 408 | 4.3 |
| L2LC | 24 | 819 | 577 | 21.3 |
| | 800 | 478 | 424 | 1.6 |
| L2LC* | 24 | 775 | 566 | 14.3 |

*Aged using the 2-step heat treatment 850° C./4 h + 800° C./8 h.
**Aged using the 2-step heat treatment 950° C./2 h + 800° C./8 h.

Figure 14:
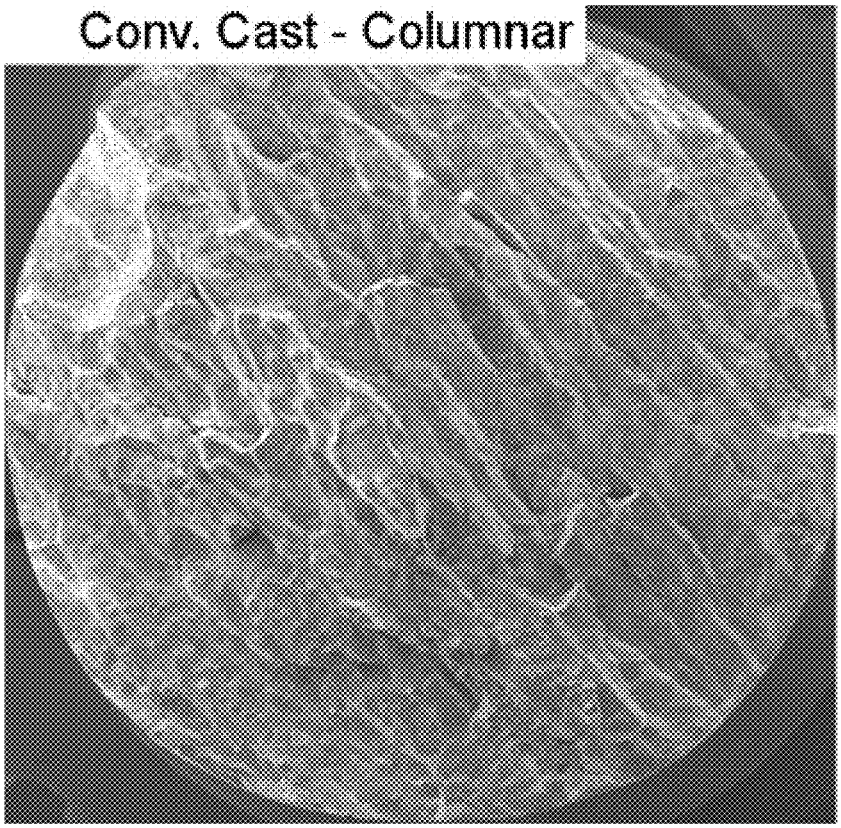
(Prior Art) FIGURE 14
FIG. 14 depicts an image illustrating fracture of conventionally cast specimens in columnar region (L2B)
Figure 15:
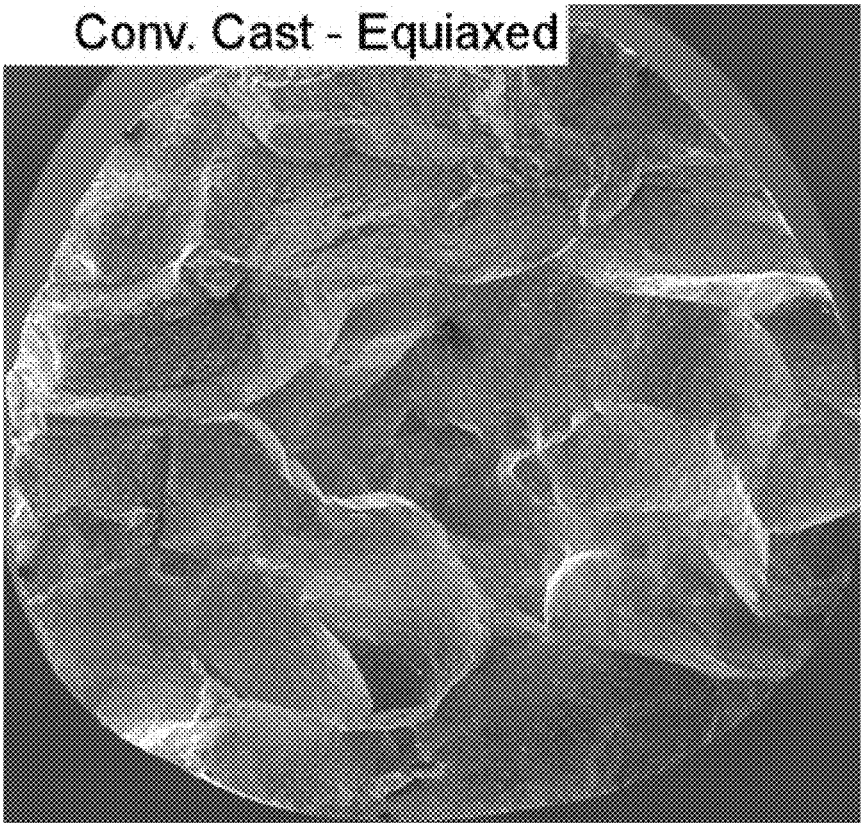
(Prior Art) FIGURE 15
FIG. 15 depicts an image illustrating fracture of conventionally cast specimens in equiaxed region (L2LC)
Figure 16:
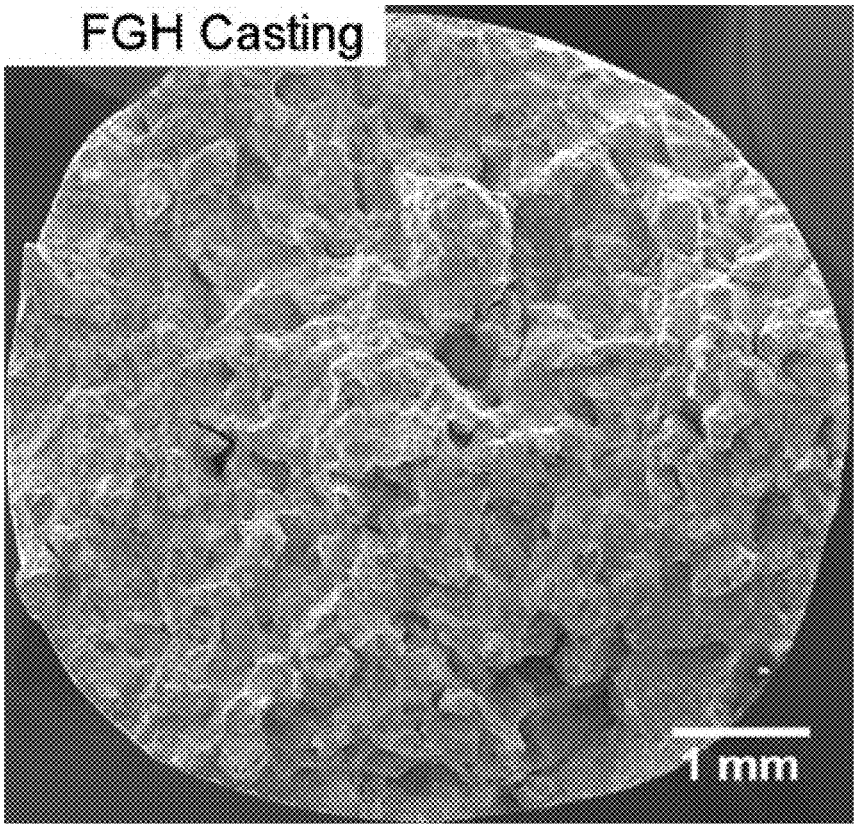
FIG. 16 depicts an image illustrating fracture of a FGH cast specimen in accordance with one embodiment of the present invention.

Fracture surfaces of selected cast alloys are shown in FIGS. 14-16. These images represent three types of general fracture observed. FIG. 14 illustrates failure of a specimen extracted from the columnar region of a conventional casting (L2B) while FIG. 15 is representative of failure of a specimen from the equiaxed region of the conventional castings (L2LC pictured). A fracture surface of the FGH casting is shown in FIG. 16 revealing the finer grain structure of the alloy. Overall, fracture analysis showed predominantly intergranular failure, particularly for specimens tested in the equiaxed region of the conventional castings. The FGH casting, however, showed evidence of limited ductility.

Figure 17:
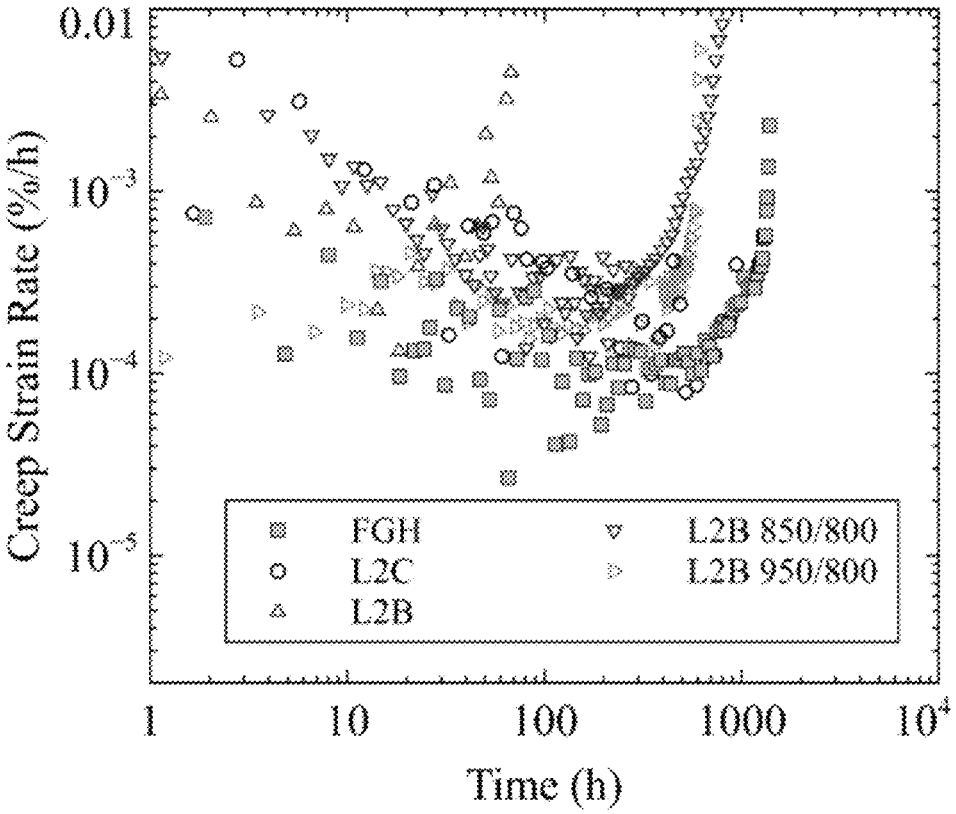
FIG. 17 depicts a graph illustrating creep strength as a function of creep life during creep testing of L2B, L2C, and FGH at 760° C./259 MPa with L2B in the three different aging conditions.
Figure 18:
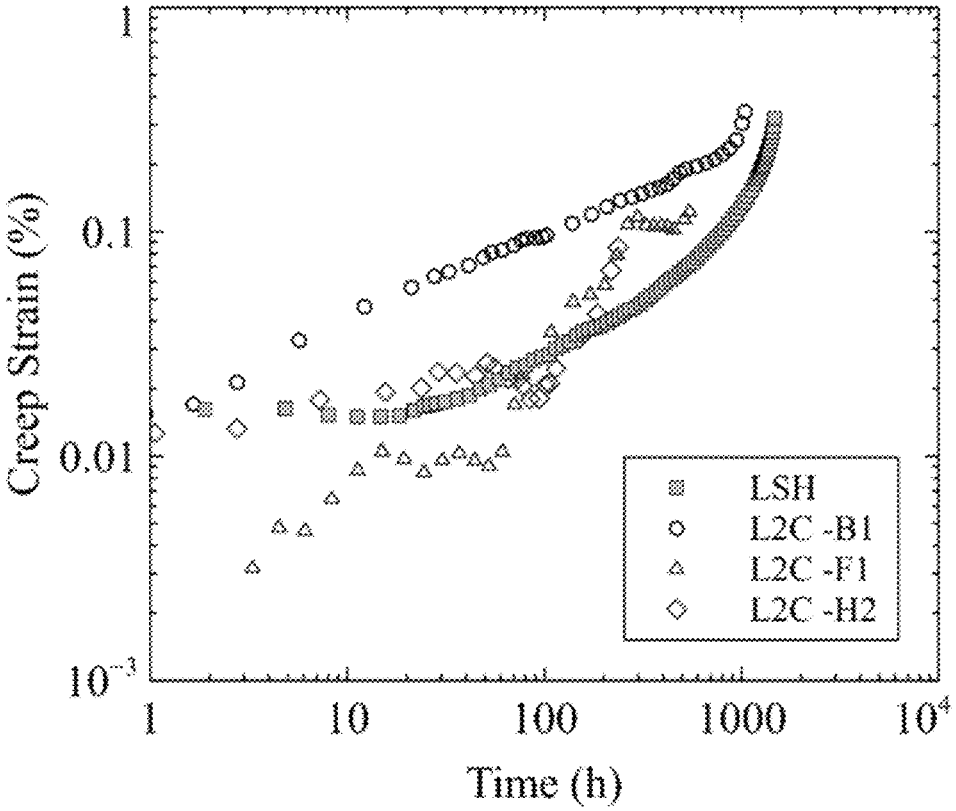
FIG. 18 depicts a graph illustrating creep strength as a function of creep life during creep testing of L2C (three specimens BI, FI, and H2) and FGH at 760° C./259 MPa.

FIG. 17 depicts a graph illustrating creep strain rate as a function of time during creep testing of L2B, L2C, and FGH at 760° C./259 MPa with L2B in the three different aging conditions. FIG. 18 depicts a graph illustrating creep strain as a function of time during creep testing of L2C (three specimens B1, F1, and H2) and FGH at 760° C./259 MPa.

The FGH casting performed better than the other conventional castings in terms of YS and UTS with values of YS close to that of the wrought product. A primary reason is the finer grain size in the FGH casting (Hall-Petch effect). The Hall-Petch effect is well known. That is YS and UTS vary inversely as a function of grain size with fine grained metals and alloys having higher YS and UTS compared to larger grained metals and alloys. However, fine grained metals and alloys typically have poor creep life compared to metals and alloys with larger grain sizes. This is not the case for the FGH articles, which is an unexpected result.

The FGH articles have long creep lives compared to the larger grained conventionally cast articles. This behavior is associated directly with carbide morphology and carbide distribution. In the FGH articles, carbides are uniformly distributed throughout the microstructure with few regions devoid of carbide. In addition, the carbides are blocky in the FGH articles whereas in the conventionally cast articles, the carbides are absent over long stretches of grain boundary length, or are thin/elongated and/or continuous, or are cellular in nature, or are a combination of these. The FGH casting approach not only changes the proportion of equiaxed to columnar zones but also changes the grain size within these zones. In doing so, the FGH approach also changes the morphology and distribution of carbides. These combined effects not only improve the tensile strength of the FGH as-cast articles but also improve creep performance as measured by the LMP (as a direct result of longer creep life).

An alternative casting approach, FGH, combines fine-grain casting techniques and computational homogenization heat treatment to improve the creep life of NiCrCoAlTi (Ni-based) superalloy (based on the nominal composition range of IN740H). This approach promotes a homogeneous physical grain structure, grain boundary precipitate repartition, and enhanced chemical homogeneity within the cast and heat-treated article. The LMP values of the FGH NiCrCoAlTi (Ni-based) superalloy cast article matched, or slightly surpassed those reported for wrought IN740H.

The macrostructure of the FGH cast articles consisted of a primary equiaxed zone and much reduced chill/columnar zones. These zones were minimized by the rapid solidification rate of the molten alloy as consequences of the low pouring superheat and the heated mold. The average grain size in the equiaxed region was considerably reduced in the FGH cast articles.

The refined grain size of the FGH cast articles led to an increased density of nucleation sites for $M_{23}C_6$, grain boundary carbides, and thus, an overall reduction in carbide thickness. This alternative approach reduced discrepancies in their repartition of carbides along the grain boundaries as well as changing the carbide morphology, leading to reduced regions of no carbide precipitation and localized stress concentrations.

Intricate grain boundaries in the FGH cast articles were developed when compared to relatively straight, or minimally curved, grain boundaries typical of the conventionally cast articles. This change in general morphological feature directly contributed to improved creep life as crack propagation was tempered by the tortuous nature of the path with enhanced opportunities for crack wedging.

The YS and UTS of the FGH cast articles were improved when compared to conventionally cast ones. The FGH cast articles values were close to the YS and UTS values reported for wrought IN740H. Changes in chemistry within the range reported for IN740H resulted in relatively considerable differences in YS, UTS, and elongation to failure in the conventional castings. Thus, further improvement in the properties of the FGH casting can be considered with respect to overall chemistry and compositional range.

The composition of the NiCrCoAlTi (Ni-based) superalloy can be varied within the range of commercial IN740H as specified in TABLE 1.

The homogenization heat treatment used in the making of the FGH as-cast article described herein was optimized using computational design. However, other combinations of time/temperature and number of segments can be utilized but ultimately must achieve the same level of homogenization (i.e., +/−1% of nominal, herein, or better) in order to maintain tensile and creep performance, i.e., high YS and creep life as measured by LMP.

As an example, aging trials on IN740H were performed and revealed variations in the size or fraction of precipitate phases such as γ' and carbides (MC and $M_{23}C_6$). Therefore, the aging heat treatment can also be targeted for specific properties. Aging can be performed using a single-step heat treatment (time and temperature) or a multi-step heat treatment, consisting of two or more aging temperatures with various holding times. The selection of such corresponds with the desire to achieve a particular set of microstructural features necessary to optimize a particular property (e.g., yield stress, creep life, fatigue life, oxidation resistance, etc.).

The superheat temperature (of the liquid metal prior to pouring) can be varied as well as the cooling rate determined by the temperature of the liquid metal and the temperature of the mold. The mold can be either pre-heated or heated in the furnace. Various temperatures can be employed. Ultimately, they must achieve a mostly equiaxed and refined grain structure in the cast ingot. A combination of possibilities exists each one resulting in a set of microstructural features that would affect strength and creep life. The approach outlined herein describes one that produced a fine-grained physical microstructure (casting approach) with a very high degree of chemical homogeneity (homogenization cycle) which subsequently yielded an as-cast article with high YS (based on the fine-grained nature of the microstructure) and long creep life (based on chemical homogeneity and carbide morphology and distribution).

Control cooling techniques also present many possibilities, utilizing either a controlled cooling rate from solution heat treatment temperature or modifying the aging heat treatment approach. That is, varying the temperature (or room temperature prior to aging), and the time at temperature, can be used to control the size and distribution of grain boundary precipitates. Many such possibilities can be explored to modify the mechanical behaviors described herein or to address other property concerns like fatigue life or oxidation resistance.

Having described the basic concept of the embodiments, it will be apparent to those skilled in the art that the foregoing detailed disclosure is intended to be presented by way of example. Accordingly, these terms should be interpreted as indicating that insubstantial or inconsequential modifications or alterations and various improvements of the subject matter described and claimed are considered to be within the scope of the spirited embodiments as recited in the appended claims. Additionally, the recited order of the elements or sequences, or the use of numbers, letters or other designations therefor, is not intended to limit the claimed processes to any order except as may be specified. All ranges disclosed herein also encompass any and all possible sub-ranges and combinations of sub-ranges thereof. Any listed range is easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as up to, at least, greater than, less than, and the like refer to ranges which are subsequently broken down into sub-ranges as discussed above. As utilized herein, the terms "about," "substantially," and other similar terms are intended to have a broad meaning in conjunction with the common and accepted usage by those having ordinary skill in the art to which the subject matter of this disclosure pertains. As utilized herein, the term "approximately equal to" shall carry the meaning of being within 15, 10, 5, 4, 3, 2, or 1 percent of the subject measurement, item, unit, or concentration, with preference given to the percent variance. It should be understood by those of skill in the art who review this disclosure that these terms are intended to allow a description of certain features described and claimed without restricting the scope of these features to the exact numerical ranges provided. Accordingly, the embodiments are limited only by the following claims and equivalents thereto. All publications and patent documents cited in this application are incorporated by reference in their entirety for all purposes to the same extent as if each individual publication or patent document were so individually denoted.

All numeric values are herein assumed to be modified by the term "about", whether or not explicitly indicated. The term "about" generally refers to a range of numbers that one of skill in the art would consider equivalent to the recited value (e.g., having the same function or result). In many instances, the terms "about" may include numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

What is claimed is:

1. A method of casting a creep-resistant Ni-based superalloy, the method comprising:

forming a feed stock comprising Nickel (Ni) and at least one of Chromium (Cr), Cobalt (Co), Aluminum (Al), Titanium (Ti), Niobium (Nb), Iron (Fe), Carbon (C), Manganese (Mn), Molybdenum (Mo), Silicon (Si), Copper (Cu), Phosphorus (P), Sulfur (S) and Boron (B);

fabricating an as-cast article comprising creep-resistant Ni-based superalloy in a predetermined shape using the feed stock and at least one process comprising vacuum induction melting (VIM), electroslag remelting (ESR) and/or vacuum arc remelting (VAR); and homogenizing the as-cast article, wherein homogenizing the as-cast article comprises a heating sequence of one hour at about 1075° C., three hours at about 1125° C., eight hours at about 1200° C. and eight hours at about 1250° C.

2. The method of claim 1, wherein the feed stock comprises at least Nickel (Ni) and Chromium (Cr).

3. The method of claim 1 wherein fabricating the creep-resistant Ni-based superalloy comprises:

melting the feed stock in a furnace, forming a liquid metal;

pouring the liquid metal into a preheated mold, forming a molten metal; and solidifying the molten metal in the preheated mold, forming the as-cast article.

4. The method of claim 3 wherein homogenizing the as-cast article further comprises forming a controlled and random dispersal of alloy constituents that reduces chemical segregation within the as-cast article.

5. The method of claim 4 wherein the homogenizing the as-cast article forms a specific element segregation below ±1% variation from the nominal chemistry of these elements throughout the as-cast article.

6. The method of claim 4 further comprises loading the feed stock into a crucible inside the furnace.

7. The method of claim 6 further comprises loading the feed stock into a zirconia crucible inside the furnace, forming a loaded feedstock.

8. The method of claim 3 wherein the furnace comprises a VIM furnace.

9. The method of claim 3 wherein melting the feed stock is carried out in at least one of a vacuum and at a partial pressure between 50 and 400 Torr of Argon (Ar).

10. The method of claim 3 wherein melting the metal Ni-based superalloy includes pouring the liquid metal into the preheated mold when the temperature of the liquid metal is between 1 and 10 degrees Celsius above the melting temperature of the loaded feed stock.

11. The method of claim 3 wherein the preheated mold is a graphite mold.

12. The method of claim 3 wherein the preheated mold includes a zirconia washcoat and is preheated prior to being placed in the furnace.

13. The method of claim 3 wherein the preheated mold is heated to about 300° C. to about 700° C. from about 10 minutes to about 5 hours.

14. The method of claim 1 wherein the as-cast article is characterizable by a level of chemical homogeneity, defined as variations between local and nominal chemistry following homogenizing and measured using wavelength dispersive x-ray fluorescence, of less than ±1%, or less than ±2%, or less than ±5%.

15. The method of claim 1 wherein the as-cast article comprises a equiaxed region with an average grain size of 289±42 μm.

16. A method of casting a creep-resistant Ni-based superalloy, the method comprising:

forming a feed stock comprising Nickel (Ni) and at least one of Chromium (Cr), Cobalt (Co), Aluminum (Al), Titanium (Ti), Niobium (Nb), Iron (Fe), Carbon (C), Manganese (Mn), Molybdenum (Mo), Silicon (Si), Copper (Cu), Phosphorus (P), Sulfur (S) and Boron (B); and fabricating an as-cast article comprising creep-resistant Ni-based superalloy in a predetermined shape using the feed stock and at least one process comprising vacuum induction melting (VIM), electroslag remelting (ESR) and/or vacuum arc remelting (VAR), wherein fabricating the creep-resistant Ni-based superalloy comprises:

melting the feed stock in a furnace, forming a liquid metal;

pouring the liquid metal into a preheated mold, forming a molten metal;

solidifying the molten metal in the preheated mold, forming the as-cast article; and homogenizing the as-cast article, wherein homogenizing the as-cast article comprises a heating sequence of one hour at about 1075° C., three hours at about 1125° C., eight hours at about 1200° C. and eight hours at about 1250° C., wherein the homogenizing the as-cast article forms a specific element segregation below ±1% variation from the nominal chemistry of these elements throughout the as-cast article.

17. The method of claim 16 wherein the as-cast article comprises an equiaxed region with an average grain size of 289±42 μm.

18. A method of casting a creep-resistant Ni-based superalloy, the method comprising:

forming a feed stock comprising Nickel (Ni) and at least one of Chromium (Cr), Cobalt (Co), Aluminum (Al), Titanium (Ti), Niobium (Nb), Iron (Fe), Carbon (C), Manganese (Mn), Molybdenum (Mo), Silicon (Si), Copper (Cu), Phosphorus (P), Sulfur (S) and Boron (B); and fabricating an as-cast article comprising creep-resistant Ni-based superalloy in a predetermined shape using the feed stock and at least one process comprising vacuum induction melting (VIM), electroslag remelting (ESR) and/or vacuum arc remelting (VAR), wherein fabricating the creep-resistant Ni-based superalloy comprises:

melting the feed stock in a furnace, forming a liquid metal;

pouring the liquid metal into a preheated mold, forming a molten metal, wherein preheating the mold comprises heating the mold to about 300° C. to about 700° C. from about 10 minutes to about 5 hours;

solidifying the molten metal in the preheated mold, forming the as-cast article; and homogenizing the as-cast article, at least two of the sequential steps of treating the cast alloy: 0.5 to 5 hours at 1075±25° C.; 1.5 to 3 hours at 1125±25° C.; 3 to 15 hours at 1200±25° C.; 3 to 24 hours at 1250±25° C., wherein the homogenizing the as-cast article forms a specific element segregation below ±1% variation from the nominal chemistry of these elements throughout the as-cast article.

19. The method of claim 18 wherein the as-cast article comprises an equiaxed region with an average grain size of 289±42 μm.

* * * * *